US007611032B2

(12) United States Patent
Brunerie et al.

(10) Patent No.: US 7,611,032 B2
(45) **Date of Patent: *Nov. 3, 2009**

(54) LOCKABLE DISPENSING HEAD

(75) Inventors: Patrice Brunerie, Tremblay en France (FR); Guiseppe Dalsant, Baselga di Pineitalie (IT); Marcel Sanchez, Paris (FR)

(73) Assignee: L'Oreal, Paris (FR)

( * ) Notice: Subject to any disclaimer, the term of this patent is extended or adjusted under 35 U.S.C. 154(b) by 472 days.

This patent is subject to a terminal disclaimer.

(21) Appl. No.: 11/043,197

(22) Filed: Jan. 27, 2005

(65) Prior Publication Data

US 2005/0184093 A1 Aug. 25, 2005

Related U.S. Application Data

(60) Provisional application No. 60/542,846, filed on Feb. 10, 2004.

(30) Foreign Application Priority Data

Jan. 27, 2004 (FR) ..... 04 50147

(51) Int. Cl.
*B67B 5/00* (2006.01)

(52) U.S. Cl. ..... 222/153.11; 222/153.12; 222/153.13; 222/402.11; 222/402.13

(58) Field of Classification Search ..... 222/153.11, 222/153.12, 402.11, 402.13, 153.13, 153.04, 222/153.14, 153.01, 402.1, 402.15, 402.21, 222/402.22, 402.23, 402.25

See application file for complete search history.

(56) References Cited

U.S. PATENT DOCUMENTS

| | | | | |
|---|---|---|---|---|
| 2,887,273 | A | 5/1959 | Anderson et al. | 239/337 |
| 3,844,448 | A * | 10/1974 | Sette | 222/153.12 |
| 4,024,988 | A * | 5/1977 | Starrett | 222/153.11 |
| 6,302,302 | B1 * | 10/2001 | Albisetti | 222/153.11 |
| 6,926,172 | B2 * | 8/2005 | Jaworski et al. | 222/153.12 |
| 7,017,785 | B2 * | 3/2006 | Lasserre et al. | 222/402.13 |
| 2002/0096539 | A1 * | 7/2002 | Milian et al. | 222/153.11 |

FOREIGN PATENT DOCUMENTS

| | | |
|---|---|---|
| EP | 1 024 094 | 8/2000 |
| FR | 1447222 | 7/1966 |
| FR | 2271995 | 12/1975 |
| GB | 1 024 094 | 8/2000 |
| WO | 01/53157 | 7/2001 |

* cited by examiner

*Primary Examiner*—J. Casimer Jacyna
(74) *Attorney, Agent, or Firm*—Oblon, Spivak, McClelland, Maier & Neustadt, L.L.P.

(57) ABSTRACT

A dispensing head, intended for actuating a dispensing element mounted on a container and for dispensing a product contained in the container, includes: a) a mechanism for fastening the head to the container; b) a dispensing duct able to communicate with the product inside the container; and c) an actuating mechanism for actuating the dispensing element. The actuating mechanism can be provided with a dispensing orifice and is able to move with respect to the duct between a first position in which the product can be dispensed and a second position in which the product cannot be dispensed and in which the dispensing element cannot be actuated. The actuating mechanism is able, in the second position, to butt against an integral portion of the fastening mechanism that prevents displacement of the actuating mechanism from the first to the second position.

33 Claims, 5 Drawing Sheets

LOCKABLE DISPENSING HEAD

CROSS REFERENCE TO RELATED APPLICATIONS

This document claims priority to French Application Number 04 50147, filed Jan. 27, 2004 and U.S. Provisional Application No. 60/542,846, filed Feb. 10, 2004, the entire contents of which are hereby incorporated by reference.

BACKGROUND OF THE INVENTION

1. Field of the Invention

The present invention relates to a head for dispensing a product intended for actuating a dispensing element mounted on a container, particularly a valve mounted on a pressurized container, and for dispensing a product contained in the container. In particular, the invention relates to a dispensing head that can be displaced between a dispensing position and a storage position.

2. Discussion of Background

Generally, dispensing heads are protected by caps in order to prevent any unintentional dispensing of product. However, the caps can easily be removed accidentally and this is not desirable, in particular when the dispensing head is provided on an aerosol-type dispenser and when the risks of leakage of the product, particularly of the aerosol propellant gas, should be prevented.

To prevent unintentional dispensing of product, it is known to produce dispensing heads that can move from a dispensing position to a storage position in which the product cannot be dispensed. U.S. Pat. No. 2,887,273 describes an example of a dispensing head of this type that has a diffuser fastened to a container and to a valve stem associated with the container, and also a push-button provided for actuating the valve stem. To move from a dispensing position to a storage position, the push-button can be rotated with respect to the diffuser. The diffuser has a hollow tube fastened to the valve stem, the tube comprising two diametrically opposed lateral spray orifices. The push-button has a skirt fitted over the tube, the skirt delimiting an opening intended to be brought opposite one or the other of the spray orifices in the dispensing position. In the storage position, the opening formed in the skirt of the push-button is positioned opposite the tube wall situated between the two orifices. No product can thus be dispensed. However, in this position, there is nothing to prevent the push-button from being depressed, with the result that product may accumulate inside the tube and the spray orifices of the diffuser. There is therefore a risk that over time the product might dry and clog up the orifices.

SUMMARY OF THE INVENTION

Accordingly, it is one of the objects of the invention to produce a dispensing head that alleviates the disadvantages of the prior art.

It is another object of the invention to produce a novel dispensing head which can prevent accidental dispensing of product.

It is a particular object of the invention to produce a head such as this that is relatively simple to produce and inexpensive.

According to the invention, these objects can be achieved by producing a dispensing head intended for actuating a dispensing element mounted on a container and for dispensing a product contained in the container. The head can include a) means for fastening the head to the container; b) a dispensing duct that is able to communicate with the product inside the container. The duct can be obtained by molding from a single piece with the fastening means with which it is secured via deformable connection means. The head can further include: c) means for actuating the dispensing element, the actuating means being provided with a dispensing orifice and being able to move with respect to the duct between a first position in which the product can be dispensed and a second position in which the product cannot be dispensed and in which the dispensing element cannot be actuated. The actuating means is able, in the second position, to butt against an integral portion of the fastening means that prevents displacement of the actuating means from the first to the second position.

A dispensing head such as this can be brought into a safety position in which the product cannot be dispensed. It is difficult to change this safety position accidentally by contrast with heads protected solely by caps that can easily be removed accidentally. The risks of bacteriological pollution outside the head are also reduced or prevented since, in the storage position, the head is not covered with a cap and thus remains exposed to air.

In addition, since the dispensing element is unable to be actuated when the aperture in the duct is blocked off, the product cannot leave the container in this position and accumulate in the duct. The risks of the duct clogging up are thus reduced or prevented.

Furthermore, the presence of the elastically deformable connection means can make it possible to produce a duct by a process of molding from a single piece with fastening means, which is able to be displaced with respect to the fastening means. Such a piece is simple to produce and is inexpensive.

Advantageously, the dispensing head can be configured so as to allow actuation of the dispensing element only when the actuating means are in the first position. The dispensing element cannot thus be actuated in an intermediate position situated between the first and the second position in order to prevent product from being able to reach the duct while the aperture in the duct is blocked off.

The dispensing head may comprise an axial stop against which the actuating means are able to bear axially, at least when they are not in the first position, so as to prevent actuation of the dispensing element. The axial stop may additionally be configured in such a way that the actuating means are able to butt axially against it between the first and the second position, namely in all the positions other than the first position.

The dispensing orifice can be formed at the end of a channel and the duct opens into at least one aperture that is able to be brought opposite the channel in the first position and able to be blocked off in the second position. Since the aperture in the duct is blocked off when the head is not in the dispensing position, the duct is closed in a sealed manner in the storage position.

The duct can open into a single aperture that is able to be brought opposite the channel.

The aperture can be a slot extending parallel to a longitudinal axis X of the head. Other form of aperture may be used.

The channel at the end of which is formed the dispensing orifice can have a length that is greater than the diameter of the dispensing orifice. By diameter of the dispensing orifice is meant the diameter of the circle when the orifice is circular, or the diameter of the circle circumscribed to the cross section of the orifice when the latter has a form other than a circle.

Advantageously, the fastening means are mounted in an axially fixed manner on the container in such a way that the head is correctly maintained on the container.

Advantageously, the connection means are elastically deformable so that they assume their initial position when the stress deforming them is removed.

The connection means allow the duct to be displaced in response to the actuation of the actuating means.

According to a preferred embodiment, the connection means include a wall transverse to a longitudinal axis X of the head, which may be wavy. This configuration of the wall allows it to be deformed easily and to return easily to its initial position.

The duct is formed along a longitudinal axis X of the head and has a first end that is able to interact with the dispensing element and a second end over which the actuating means are fitted. Thus, the duct directly transmits the pressure exerted on the actuating means to the dispensing element.

A point can be arranged inside the duct so as to define an annular passage for the product over at least part of the duct.

The actuating means may be able to be rotated about the axis X between the first and second positions.

Advantageously, the dispensing head may include at least two radial stops limiting the rotational movement of the actuating means.

Advantageously still, the dispensing head may include audible identification means for signaling positioning into one or other of the first and second positions. The audible identification means may include the interaction of a first relief formed on the actuating means and of a second relief, the first relief being able, during displacement of the actuating means with respect to the duct, to come into contact with the second relief and to overcome it by deforming it elastically so as to produce an audible signal. The user can thus be assured that the head is correctly placed in one or other of the positions, and in particular in the storage position.

The dispensing head may also include visual identification means for identifying the first and second positions.

The dispensing orifice may be defined by an attached nozzle or an attached grid for dispensing a product in mousse form.

The invention also relates to a unit for packaging and dispensing a product including: a container containing the product and equipped with a dispensing element; a dispensing head as just described and provided for activating the dispensing element in order to dispense the product.

The container may be pressurized and the dispensing element may be a male valve including a valve stem over which the duct is fitted, or else a female valve, that is to say without a valve stem, into which the duct is fitted. Alternatively, the container can be under atmospheric pressure and can be equipped with a pump.

The invention is particularly useful for packaging and dispensing a cosmetic or care product, particularly a deodorant product.

An additional subject of the invention, independently of or in combination with the foregoing, is a unit for packaging and dispensing a deodorant product including: a) a container; b) a deodorant product contained inside the container; and c) a dispensing head intended for actuating a dispensing element mounted on the container and for dispensing the product. The head can include:

i) means for fastening the head to the container;

ii) a dispensing duct that is able to communicate with the product inside the container, the duct being obtained by molding from a single piece with the fastening means with which it is secured via deformable connection means;

iii) means for actuating the dispensing element, the actuating means being provided with a dispensing orifice formed at the end of a channel and being able to move with respect to the duct between a first position in which the product can be dispensed and a second position in which the product cannot be dispensed and in which the dispensing element cannot be actuated; the duct opening into at least one aperture that is able to be placed opposite the channel in the first position and able to be blocked off in the second position.

Within the meaning of the present invention, the term "deodorant product" denotes any product containing a composition capable of reducing the flow of sweat and of masking, absorbing, improving and/or reducing the unpleasant odor resulting from the decomposition of human sweat by bacteria.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
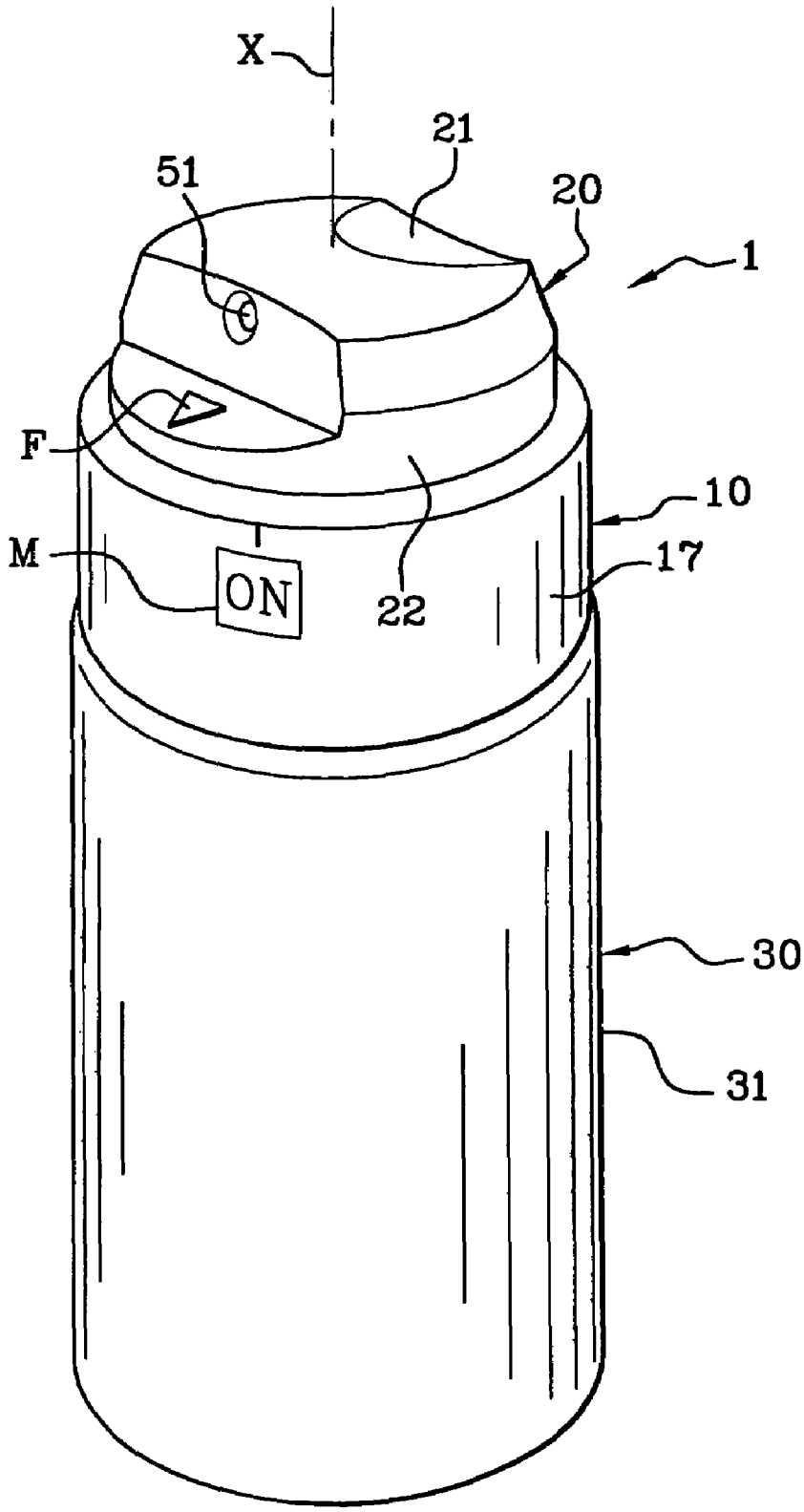
FIG. 1 illustrates a perspective view of an embodiment of a packaging and dispensing unit provided with a dispensing head according to the invention.
Figure 2:
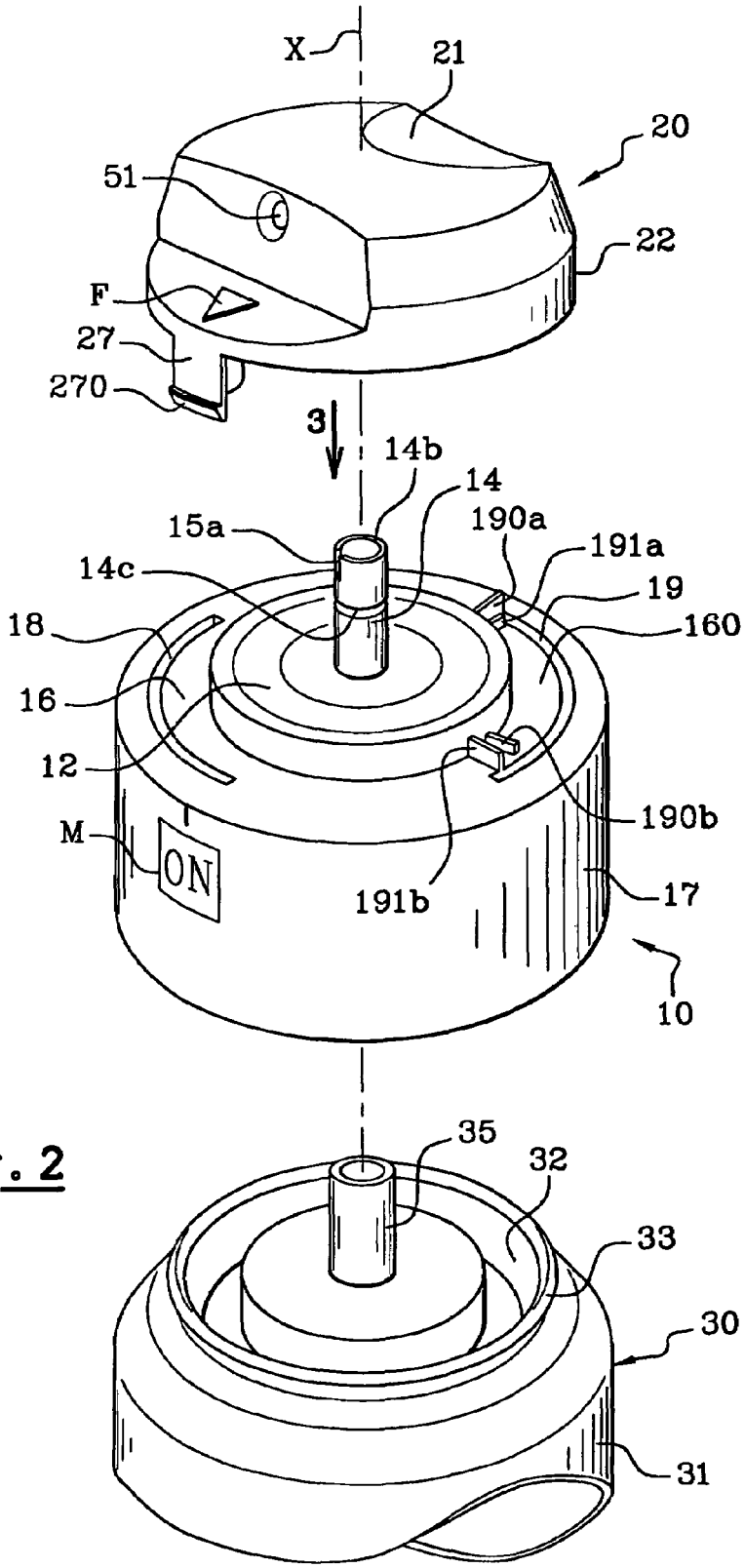
FIG. 2 illustrates an exploded view of the embodiment of FIG. 1.

The packaging and dispensing unit illustrated in FIGS. 1 to 7 is formed by a pressurized container 30 to which is fastened a dispensing head 1 according to the invention.

The container 30 is formed by a pressurized can of axis X, formed by an axisymmetric cylindrical body 31, the upper end of which is closed by a cup 32 crimped onto a rolled edge 33 of the container. The cup 32 is provided with a valve 34 that has a hollow valve stem 35 and can be actuated for example by depressing the valve stem. Alternatively, the valve can be actuated by tilting the valve stem.

The container 30 may contain a product to be sprayed, for example a cosmetic product, and a propellant gas, which may or may not be stored in a liquefied form in the container 30 and may or may not be delivered with the product. The product then leaves in the form of spray, that is to say in the form of fine particles suspended either in the gas or in the air.

The dispensing head 1 is also of axis X and is formed by two parts that can move relative to one another between two positions, a first position allowing the product to be dispensed and a second, storage position in which the product cannot be dispensed. The first part of the head includes a collar 10 that makes it possible to protect the valve stem and is intended to be fastened to the container. The second part includes a push-button 20 allowing the valve to be actuated and being able to be rotated with respect to the collar. Each of the two pieces can be obtained by molding a thermoplastic from a single piece.

Figure 4:
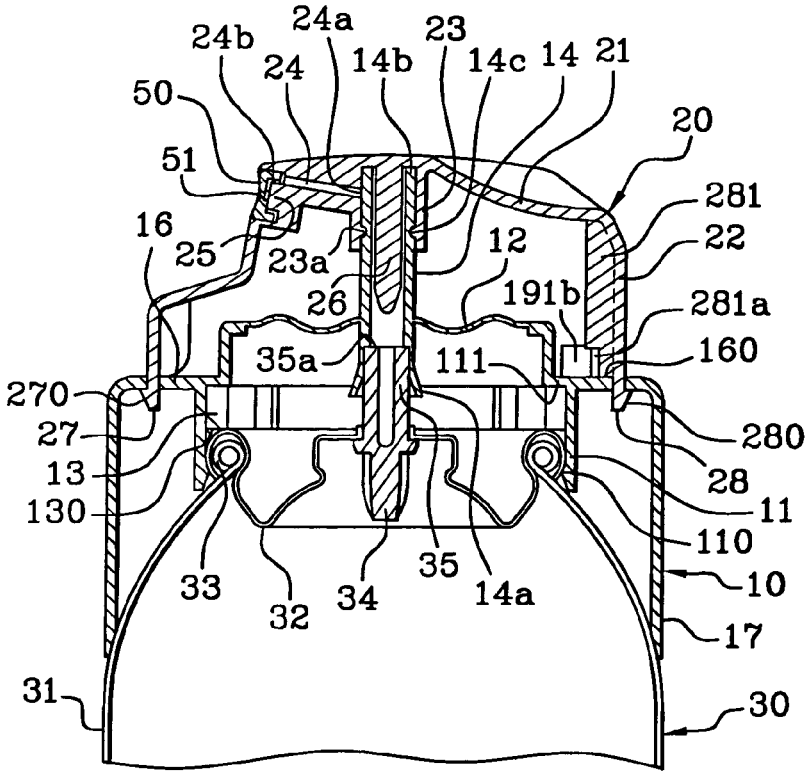
FIG. 4 represents in axial section the dispensing head in the closed position.
Figure 5:
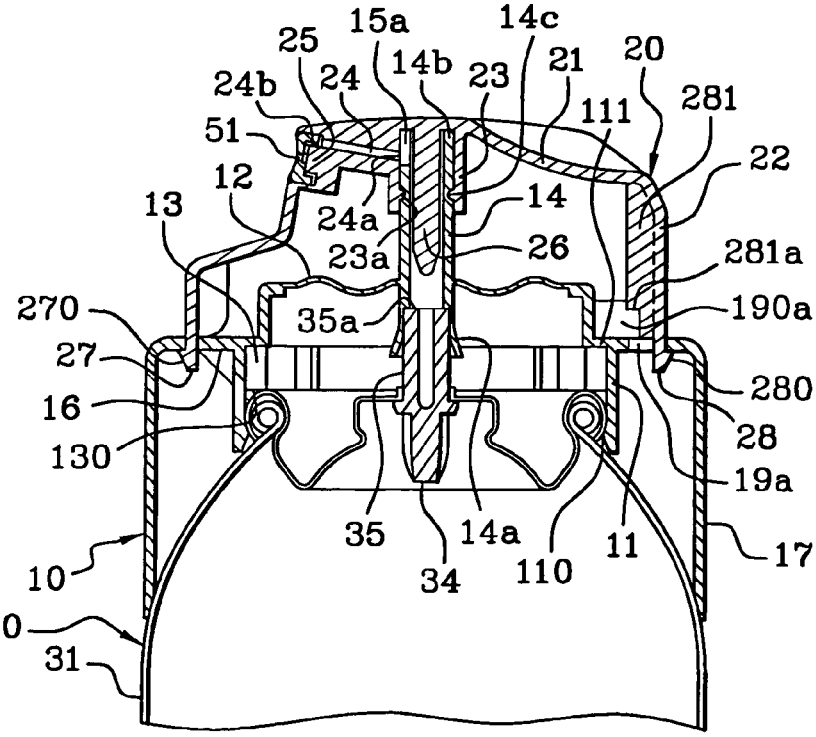
FIG. 5 represents in axial section the dispensing head in a dispensing position, the valve not being actuated.
Figure 7:
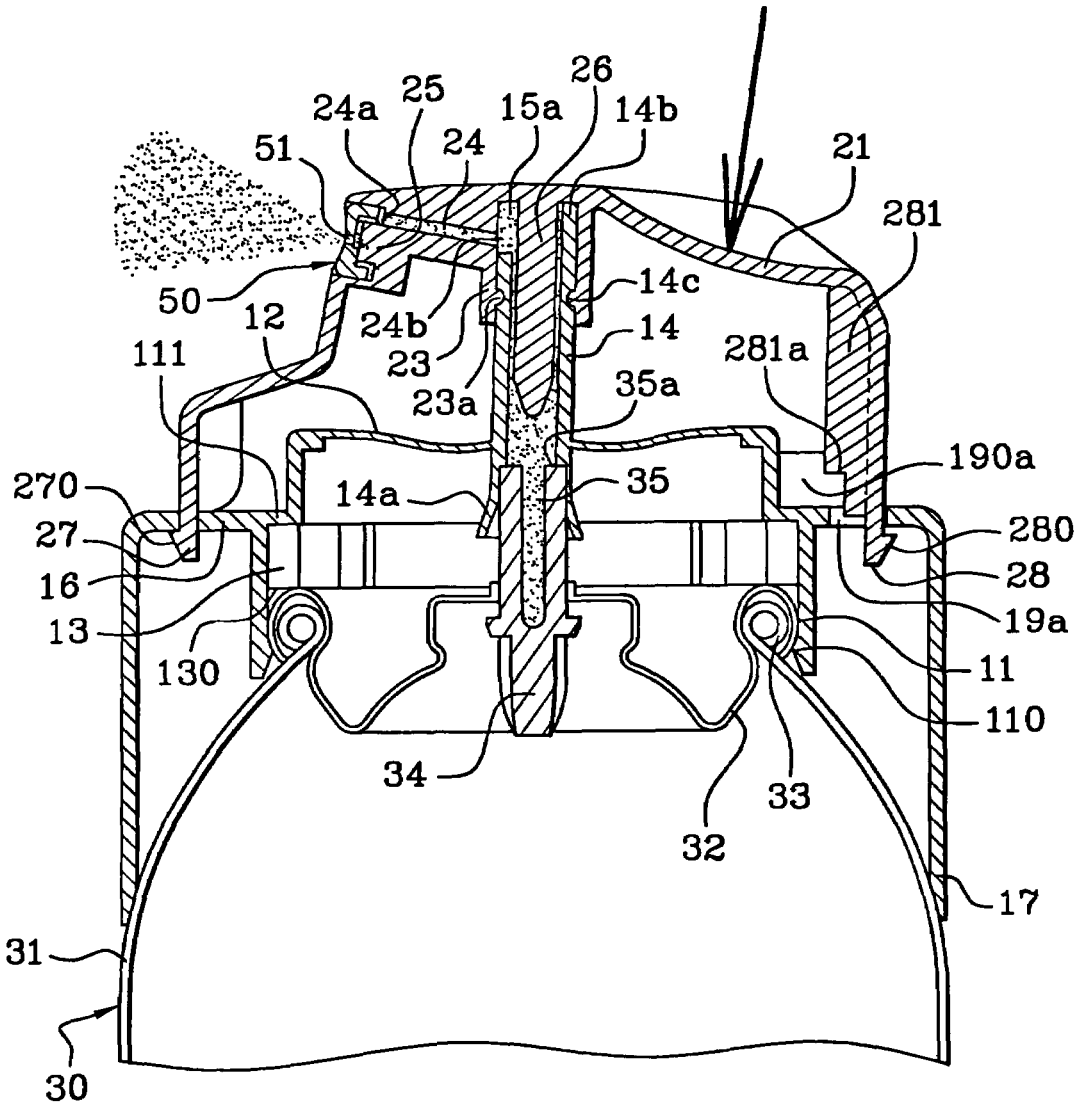
FIG. 7 represents in axial section the dispensing head in the dispensing position, the valve being actuated.

The collar 10 includes a fastening skirt 11 for fastening the head to the container. The fastening skirt 11 is provided with an annular flange 110 on its inner wall for fastening it to the container by snap-fitting under the rolled edge 33 of the container and the cup 32. The fastening skirt 11 has a radial offset 111 towards the inside of the skirt and is extended axially above the offset as far as an upper end, from which end is formed a transverse wall 12. Radial fins 13, which are angularly spaced over the periphery of the internal surface of the fastening skirt, extend parallel to the axis X from the offset 111 as far as a lower free edge 130. The free edge 130 is designed to butt against the container when the collar is in a position in which it is mounted on the container, as can be seen in FIGS. 4, 5 and 7. The fins 13 thus make it possible to limit the extent to which the collar is depressed axially when snap-fitting it onto the container.

The transverse wall 12 is a thin wall that has a wavy structure such that it is elastically deformable, which allows it to be deformed when it is stressed axially. The wall 12 is traversed at its centre by a duct 14 formed in the axis X.

The duct 14 extends on either side of the transverse wall 12 from an open lower end 14*a*, which is fitted over the valve stem 35, as far as an upper end 14*b*, likewise open, over which is fitted an axial skirt 23 of the push-button. An annular groove 14*c* is provided on the external surface of the duct 14 in order to accommodate an annular bead 23*a* provided on the internal surface of the axial skirt 23 of the push-button so as to axially maintain the push-button on the collar. Furthermore, the interaction of the annular bead 23*a* with the annular groove 14*c* provides sealing between the duct and the inside of the push-button.

The duct 14 has an axisymmetric cylindrical shape and defines, in its lower part, a shouldered housing in which the upper part of the valve stem 35 may engage in a substantially sealed manner, the upper end 35*a* of which valve stem butts against the shoulder of the housing. The lower end 14*a* of the duct is flared slightly so as to make it easier to place the duct on the valve stem. The upper end 14*b* has an axial slot 15*a* that defines a passage allowing the product to leave.

The fastening skirt 11 is connected at the level of the offset 111, via an annular transverse wall 16, to an outer skirt 17 that is concentric to the fastening skirt 11. The outer skirt 17 is intended to form the continuation of the wall of the container when the dispensing head is mounted on the container. Two marks M are provided on the external surface of this skirt 17 and these visually indicate the angular positions of the slot 15*a* and of the blocking position. A first mark M is, for example, the word "ON", which corresponds to the position of the slot 15*a* and which therefore allows the product to be dispensed, and a second mark M is, for example, the word "OFF", which corresponds to the storage position.

Figure 3:
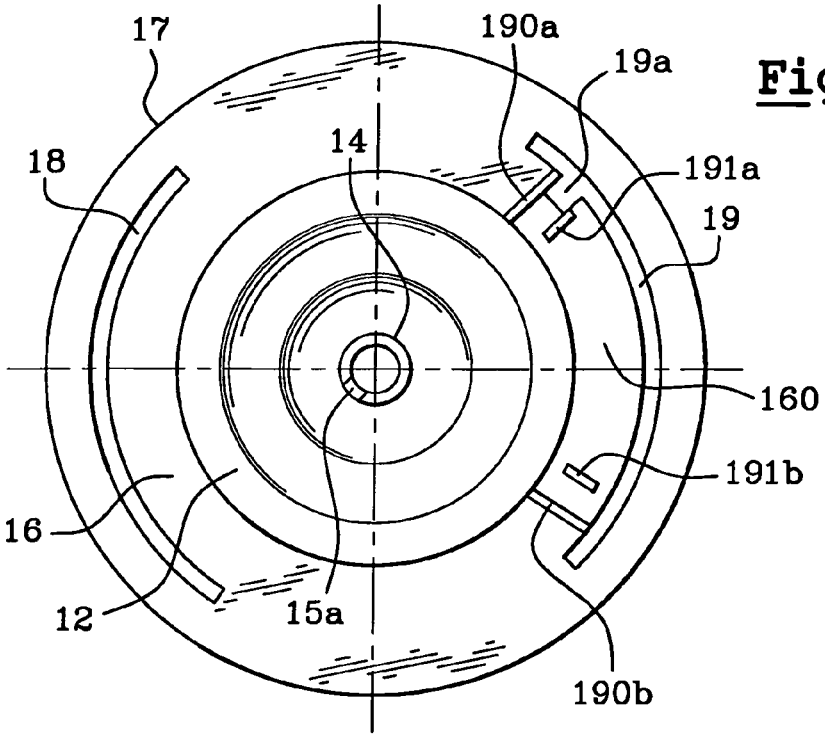
FIG. 3 represents a plan view in the direction of the arrow 3 of part of the dispensing head illustrated in FIG. 2.

As can be seen in more detail in FIG. 3, the annular transverse wall 16 of the collar is traversed by two circularly arcuate openings 18 and 19, which are diametrically opposed on the annular transverse wall, formed in the vicinity of the outer skirt 17 and in which two tabs of the push-button are intended to be displaced, as will be seen in detail hereinafter. The first opening 18 is formed towards the axial slot 15*a* of the duct and the second opening 19 is formed to the rear of the axial slot 15*a*.

The second circularly arcuate opening 19 is terminated, in the vicinity of one of its ends, by an opening portion 19*a* that radially extends the opening 19 inwardly. The opening portion 19*a* is formed along the diameter passing through the axial slot 15*a*. In other words, the opening 19 is relatively large at location 19*a* relative to other locations of the opening 19. The portion 160 of the annular transverse wall 16 that is situated in the vicinity of the second opening 19, inside the circular arc, acts as an axial stop for the push-button, as will be seen in detail subsequently.

Two vertical stops 190*a* and 190*b* respectively border each end of the second circularly arcuate opening 19. The stops 190*a* and 190*b* extend axially from the annular transverse wall 16 as far as an upper free edge, and extend radially from the external surface of the fastening skirt 11 as far as the slot 19. The stops 190*a* and 190*b* are relatively rigid owing to the fact that they are secured both to the transverse annular wall 16 and to the fastening skirt 11 and thus make it possible to limit the rotational movement of the push-button.

Two radial tongues 191*a* and 191*b* extend axially from the annular transverse wall 16 as far as an upper free edge 191*a'* and 191*b'*. One is formed towards the inner edge of the opening portion 19*a* and the other is formed at a distance from the stop 190*b*. The tongues 191*a* and 191*b* extend over an axial height below that of the stops 190*a* and 190*b* and are also less wide than the stops 190*a* and 190*b*. The tongues 191*a* and 191*b* do not extend as far as the circularly arcuate opening 19 and are formed at a distance from the fastening skirt 11 such that they are elastically deformable. The tongues 191*a* and 191*b* interact with the push-button in such a way as to constitute an audible identification means for indicating movement into the use position and into the storage position.

Preferably, the dispensing position is quite distant angularly from the storage position so as to completely separate these two positions. The user is thus prevented from moving the push-button into the dispensing position without wishing to do so. Since the two positions are relatively distant, the push-button can thus assume various intermediate positions in which it is not desirable for the dispensing element to be able to be actuated. That is why it is preferable for the portion 160 to act as an axial stop for the push-button between these two positions. However, as an alternative, provision can be made for the portion 160 of the annular transverse wall 16 that is situated in the vicinity of the second opening 19, inside the circular arc, to be able to act as an axial stop for the push-button only in the storage position. The portion 160 situated between the two radial tongues 191*a* and 191*b* then extends radially at the same level as the portion 160 of the wall that is situated between the tongue 191*a* and the vertical stop 190*a*.

To actuate the valve, the dispensing head comprises a push-button 20 that has an upper wall 21 intended to act as a bearing point for a finger of the user. The upper wall 21 is connected at its periphery to a first skirt 22 whose diameter is smaller than the diameter of the outer skirt 17 of the collar.

The push-button 20 has, inside the first skirt 22, a second skirt 23 of axisymmetrical cylindrical shape. The skirt 23 is of axis X and fits over the upper end 14*b* of the duct 14 about which it can rotate. Opening into the upper part of the skirt 23, by way of a first end 24*a*, is a substantially radial channel 24, the second end 24*b* of which opens into a nozzle support. The nozzle support includes a stud 25, or centre post, to which can be fastened a conventional nozzle 50 with swirl-inducing channels. The nozzle 50 defines a dispensing orifice 51.

An arrow F is provided on the upper wall 21 to indicate the angular position of the end 24*a* of the channel 24, so that, when it is brought opposite one or other mark M provided on the collar, that visually indicates to the user the position in which he can actuate the push-button for dispensing the product and the storage position.

A point 26 of axis X is formed inside the second skirt 23 and is inserted inside the duct 14 when the push-button is mounted on the collar. The point 26 has a diameter that is slightly smaller than the diameter of the duct so as to form an annular passage for the product inside the duct. The point 26 makes it possible to limit the dead volume inside the duct and thus limit the pressure drops inside the duct so as to optimize the flow rate at which the product leaves. In addition, by reducing the dead volume, the volume of product that the dispensing head can contain between the valve 34 and the dispensing orifice 51 is reduced. Thus, spraying of the product through the dispensing orifice stops more or less at the moment when the user releases the push-button, that is to say as soon as the valve is no longer open, since the amount of product remaining inside the head is relatively small.

Figure 6:
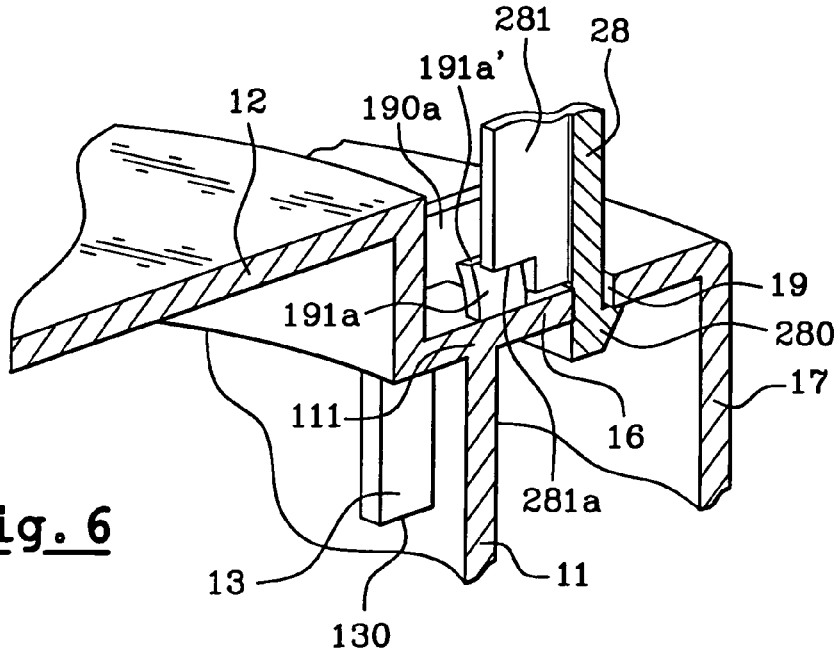
FIG. 6 represents a detail of the dispensing head when moving from the closed position to the dispensing position.

The peripheral skirt 22 of the push-button is continued axially, in its lower part, over two diametrically opposed angular portions, by way of two tabs 27 and 28 each intended to be displaced respectively in the circularly arcuate openings 18 and 19 provided in the collar. Each tab 27 and 28 is provided at its lower end with a hook 270 and 280 that butts under the annular transverse wall 16 when the tabs pass through the openings 18 and 19. The hooks 270 and 280 serve to axially maintain the push-button on the collar. The tab 27, situated towards the dispensing orifice 51, is intended to be displaced in the circularly arcuate opening 18. The tab 28 is intended to be displaced in the circularly arcuate opening 19. The tab 28 comprises a rib 281 whose axial length and radial length are sufficient to butt against each stop 190*a* and 190*b* during the rotational movement of the push-button on the collar. The rib 281 has a shoulder 281*a* in its lower part that allows it to pass by at a distance from the vertical edge of the tongues 191*a* and 191*b*. However, the shoulder 281*a* comes into contact with the upper free edges 191*a*′ and 191*b*′ of each tongue 191*a* and 191*b* and overcomes them by deforming them elastically, as can be seen in FIG. 6, in such a way as to produce an audible signal.

In the storage position represented in FIG. 4, the duct 14 blocks off the end 24*a* of the channel 24 so as to prevent any communication between the outlet orifice 51 and the inside of the dispensing duct 14. The duct is thus closed in a sealed manner by the interaction of two cylindrical pieces. In this position, the rib 281 butts against the stop 190*b*. In addition, the tab 28 passes through the slot 19 and is situated at that end of the opening 19 remote from the opening 19*a*. The lower end of the rib 281 formed on the push-button butts axially against the portion 160 of the annular transverse wall 16 so that, if the user presses on the push-button 20, in particular on the region of the upper wall 21 situated at the opposite side from the dispensing orifice 51, the push-button cannot be depressed and cannot therefore actuate the valve 34. This abutment of the rib 281 against the transverse wall is due to the fact that the rib 281 is larger than the opening 19 at positions away from the dispensing position 19*a*. Any unintentional actuation of the valve is thus prevented. Two reinforcing ribs (not shown) that extend axially on either side of the rib 281 and are diametrically opposed may additionally be provided on the internal surface of the peripheral skirt 22 of the push-button, these ribs being intended to butt axially against a ring extending axially around the transverse wall 12. These reinforcing ribs make it possible to prevent the push-button from being tilted when pressing on the sides of the upper wall 21 of the push-button. The ring should of course include cutouts that allow the push-button to be depressed in the dispensing position.

In order to dispense the product, the user turns the push-button 20 about the axis X so as to position the arrow F to face the mark "ON". During the rotational movement of the push-button, the tab 27 is displaced in the circularly arcuate opening 18 and the tab 28 is displaced in the circularly arcuate opening 19 until the shoulder 281*a* of the rib 281 comes up against the tongue 191*a* and, by virtue of its elasticity, overcomes it in order to butt against the stop 190*a*, at the same time emitting an audible signal allowing the user to know that the push-button is placed in the dispensing position. In this position, represented in FIG. 5, the rib 281 is situated above the opening 19*a* and the dispensing orifice 51 communicates with the inside of the duct 14, via the slot 15*a*.

The user can then actuate the valve by pressing on the push-button, as has been represented in FIG. 7. By pressing on the upper wall 21, in a preferred embodiment the rib 281 of the tab 28 is pushed into the opening portion 19*a* while the tab 27 remains hooked to the transverse wall 16 by means of the hook 270. The rib 281 can enter the opening portion 19*a* because the rib 281 has a size smaller than the opening at this dispensing position. The skirt 23 is then displaced with a movement having an axial and radial component, moving along with it the duct 14, over which the skirt is fitted, the movement of the duct being possible by virtue of the fact that the wall 12 deforms. The lower end 14*a* of the duct in turn exerts a pressure on the valve stem 35, which is pushed in so as to actuate the valve 34. The product contained in the container then leaves the container through the inside channel of the valve stem and reaches the dispensing orifice 51, passing through the duct 14 and the channel 24. When the user releases the push-button, the valve stem rises again and dispensing of the product is broken off. When the user no longer wishes to spray the product, he turns the push-button so as to position it at the other end of the opening 19.

When the user does not wish to dispense the product, he turns the push-button 20 about the axis X so as to position the arrow F to face the mark "OFF". Here again, the tab 27 is displaced in the circularly arcuate opening 18 and the tab 28 is displaced in the circularly arcuate opening 19 until the shoulder 281*a* of the rib 281 overcomes the tongue 191*b*, emitting an audible signal, and until the rib 281 comes up against the stop 190*b*, assuring the user that the push-button is placed in the storage position and no longer risks of being depressed.

In the foregoing detailed description, reference has been made to preferred embodiments of the invention. It is obvious that alternatives may be introduced thereto without departing from the spirit of the invention as claimed hereinafter. Provision may be made in particular to add a cap to cover the dispensing head, even if it is not indispensable.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A dispensing head for actuating a dispensing element mounted on a container, said head comprising:

a) fastening means for fastening the head to the container;

b) a dispensing duct able to communicate with the product inside the container; and c) actuating means for actuating the dispensing element, the actuating means being provided with a dispensing orifice and being able to move with respect to the duct between a first position in which the product can be dispensed and a second position in which the product cannot be dispensed and in which the dispensing element cannot be actuated, wherein in the first position, said actuating means are able to butt against a first integral portion of said fastening means, and wherein in the second position, the actuating means are able to butt against a second integral portion of said fastening means so as to stop a displacement of the actuating means from the first to the second position, wherein the dispensing orifice is formed at an end of a channel and the duct opens into at least one aperture opposite the channel in the first position and blocked off in the second position, and wherein said fastening means include an annular transverse wall that defines an arcuate opening terminating at a first end, wherein said arcuate opening defines an opening portion at said first end, wherein said opening portion is configured such that a portion of said actuating means passes through said arcuate opening at said opening portion when a pressure is applied to said actuating means in said first position.

2. A dispensing head according to claim 1, wherein the dispensing element can be actuated only when the actuating means are in the first position.

3. A dispensing head according to claim 1, further comprising an axial stop against which the actuating means bear axially, at least when they are in the second position, so as to prevent actuation of the dispensing element.

4. A dispensing head according to claim 3, wherein the axial stop is configured in such a way that the actuating means bear axially against said axial stop between the first and the second position.

5. A dispensing head according to claim 1, wherein the duct opens into a single aperture opposite the channel.

6. A dispensing head according to claim 1, wherein the at least one aperture is a slot extending parallel to a longitudinal axis X of the head.

7. A dispensing head according to claim 1, wherein the channel has a length that is greater than the diameter of the dispensing orifice.

8. A dispensing head according to claim 1, wherein the means for fastening are mounted in an axially fixed manner on the container.

9. A dispensing head for actuating a dispensing element mounted on a container, said head comprising:

a) a fastener that fastens the head to the container, b) a dispensing duct able to communicate with the product inside the container; and c) an actuator that actuates the dispensing element, the actuator being provided with a dispensing orifice and being able to move with respect to the duct between a first position in which the product can be dispensed and a second position in which the product cannot be dispensed and in which the dispensing element cannot be actuated, wherein in the first position, said actuator is able to butt against a first integral portion of said fastener, wherein in the second position, the actuator is able to butt against a second integral portion of said fastener so as to stop a displacement of the actuator from the first to the second position, wherein said duct is secured to said fastener via a deformable connection, and wherein the duct and the fasteners form a single piece.

10. A dispensing head according to claim 9, wherein the connector is elastically deformable.

11. A dispensing head according to claim 9, wherein the connector allows the duct to be displaced in response to the actuation of the actuator.

12. A dispensing head according to claim 9, wherein the connector includes a wall transverse to a longitudinal axis X of the head.

13. A dispensing head according to claim 12, wherein said wall is wavy.

14. A dispensing head according to claim 9, wherein the duct has a first end that is able to interact with the dispensing element.

15. A dispensing head according to claim 14, wherein the duct has a second end over which the actuator is fitted.

16. A dispensing head according to claim 9, wherein the duct is formed along a longitudinal axis X of the head.

17. A dispensing head according to claim 9, wherein a point is arranged inside the duct so as to define an annular passage for the product over at least part of the duct.

18. A dispensing head according to claim 9, wherein the actuator is able to be rotated about a longitudinal axis X of the head between the first and second positions.

19. A dispensing head according to claim 9, further comprising audible identification means for signaling positioning into at least one of the first and second positions.

20. A dispensing head according to claim 19, wherein the audible identification means include an interaction of a first relief formed on the actuator and of a second relief, the first relief being able, during displacement of the actuator with respect to the duct, to come into contact with the second relief and to overcome said second relief by deforming said second relief elastically so as to produce an audible signal.

21. A dispensing head according to claim 9, further comprising visual identification means for identifying the first and second positions.

22. A dispensing head according to claim 9, wherein the dispensing orifice is defined by an attached nozzle.

23. A unit for packaging and dispensing a product comprising:

a container containing the product and equipped with a dispensing element surmounting the container; and a dispensing head according to claim 9 provided for activating the dispensing element in order to dispense the product.

24. A unit according to claim 23, wherein the container is pressurized and the dispensing element is a valve.

25. A unit according to claim 24, wherein the duct is fitted over a valve stem of the valve.

26. Use of a unit according to claim 23 for packaging and dispensing a cosmetic or care product.

27. A dispensing head according to claim 9, wherein said product enters said dispensing duct in said first position when a pressure is applied to said actuator, and further comprising an axial stop against which the actuator bear axially in said second position so as to prevent actuation of the dispensing element so that said product cannot enter said dispensing duct in said second position even when said pressure is applied to said actuator.

28. A dispensing head according to claim 9, wherein:

said dispensing duct extends along an axis of the dispensing head, said actuator are configured to follow a rotational movement about said axis from said first position toward said second position, and said second integral portion of said fastener stops said rotational movement at said second position so that said rotational movement cannot continue passed said second position around said axis toward said first position.

29. A dispensing head according to claim 9, wherein said arcuate opening terminates at a second end, wherein said arcuate opening at said second end is configured such that said portion of said actuator axially bears against said annular transverse wall and cannot pass through said arcuate opening at said second end even when said pressure is applied to said actuator.

30. A dispensing head according to claim 9, wherein said arcuate opening is configured such that said portion of said actuator axially bears against said annular transverse wall and cannot pass through said arcuate opening at positions other than said first end even when said pressure is applied to said actuator.

31. A dispensing head according to claim 9, wherein said dispensing duct opens into an aperture that is diametrically aligned with said opening portion of said arcuate opening in said annular transverse wall.

32. A dispensing head according to claim 9, wherein said connector is part of said single piece.

33. A dispensing head according to claim 9, wherein said actuator comprises an upper wall for receiving an actual stress from a user, and whereby the deformable connector includes a wall that is distinct from said upper wall of the actuator, positioned axially between the container and the upper wall, and elastically deformable in response to the axial stress.

* * * * *